US008250987B1

(12) United States Patent
Morley et al.

(10) Patent No.: US 8,250,987 B1
(45) Date of Patent: Aug. 28, 2012

(54) FRANGIBLE KINETIC ENERGY PROJECTILE FOR AIR DEFENSE

(75) Inventors: Andrew Morley, New York, NY (US); Mohan J. Palathingal, Oradell, NJ (US); Leon Manole, Great Meadows, NJ (US); Ernest L. Logsdon, Jr., Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 443 days.

(21) Appl. No.: 12/502,307

(22) Filed: Jul. 14, 2009

(51) Int. Cl.
*F42B 12/56* (2006.01)

(52) U.S. Cl. ..... 102/506; 102/438; 102/439; 102/517; 102/501

(58) Field of Classification Search ..... 102/438, 102/439, 481, 489, 494, 495, 502, 503, 506, 102/516, 517, 526
See application file for complete search history.

(56) References Cited

U.S. PATENT DOCUMENTS 1,244,046 A * 10/1917 Ffrench ..... 102/494
3,951,040 A * 4/1976 Ziemba ..... 89/14.05
4,066,018 A * 1/1978 Ignatjev ..... 102/494
5,033,385 A * 7/1991 Zeren ..... 102/439
5,648,637 A * 7/1997 Clark, III ..... 102/438
7,007,608 B2 * 3/2006 Flanagan ..... 102/494
7,040,235 B1 * 5/2006 Lloyd ..... 102/489

* cited by examiner

*Primary Examiner* — James Bergin
(74) *Attorney, Agent, or Firm* — Michael C. Sachs

(57) ABSTRACT

A Kinetic Energy penetrator round is shown effective in neutralizing incoming air borne threat munitions such as rockets, artillery, or mortars for instance, without posing a threat in urban environments to harm bystanders on the ground. There are also no hazards or expense with this round of cleaning up unexploded ordnance, which might have occurred with other types of rounds due to unreliability of self destruct mechanisms. Shown herein is a kinetic energy penetrator for air defense that merely self destructs beyond its operational range into fragments that are not lethal to personnel on ground; no pyrotechnic or energetic materials means are used to activate this self destruct process. A full bore projectile structure is shown that is composed of plural axi-symmetric circular disks stacked on each other and tied by a shape memory metal wire of Nitinol. While operational as a joined group, the disks are a formidable round to kill an incoming air target. After the self destruct phase however, each disk is separated from adjacent disks on either side by a spring mechanism that enables separation after the process is initiated in flight when the Nitinol wire deforms due to heating from air drag. Each disk then proceeds alone with low enough terminal kinetic energy on the ground to be less than lethal.

6 Claims, 3 Drawing Sheets

FRANGIBLE KINETIC ENERGY PROJECTILE FOR AIR DEFENSE

U.S. GOVERNMENT INTEREST

The inventions described herein may be made, used, or licensed by or for the U.S. Government for U.S. Government purposes.

BACKGROUND AND BRIEF SUMMARY OF INVENTION

Kinetic Energy penetrators are very effective in neutralizing incoming air borne threat munitions such as rockets, artillery or mortars, for instance. These penetrators are typically monolithic cylindrical objects that are made from high density materials, to enhance their ability to penetrate and defeat the threat and are spin stabilized in their flight to their target. However, the high kinetic energy and ballistic mass of these penetrators poses a problem in urban environments, because they still possess enough energy to kill bystanders and friendly troops when they return to the ground. This problem restricts the use of an otherwise effective air defense munitions. Other solutions to this problem are self destructing high explosive munitions, which after a preset time in flight detonate, after it has passed its effective operational range. The problem with this class of projectiles is that of dealing with the hazards of cleaning up unexploded ordnance, which occur due to unreliability of the self destruct mechanism. Shown herein is a kinetic energy penetrator for air defense, that self destructs beyond its operational range into fragments that are not lethal to personnel on ground. The penetrator does not use pyrotechnic or energetic materials means to activate the self destruct process. The proposed solutions are mechanisms that still allow the use of dense materials, but effectively reduce collateral damage by fragmenting the penetrator without the use of pyrotechnic means. A full bore projectile structure is shown that is composed of a plurality of axi-symmetric disks stacked on each other. Preferred embodiments include a circular disk with a hole in the center, such that a stack of such disks creates a channel through the axis of the projectile, thus the penetrator structure would be composed of a coaxial stack of axi-symmetric disks. Each disk is sized so that its individual ballistic coefficient ensures that aerodynamic drag (compared hypothetically to the drag if it were the shape of a rod or needle rather than circular) is sufficient to reduce terminal energy to below levels established for lethal injury to ground personnel which is considered to be approximately 75 Joules on impact. Another embodiment utilizes disks which although are not all alike are sized according to ballistic need for improved flight characteristics on a case by case basis. Each disk also retains its stability in flight from the spin imparted to its parent projectile. This ensures that a maximum frontal area of the disk is presented to the air stream for the remainder of the flight, ensuring maximum drag and therefore minimal terminal energy. Each disk is separated from succeeding disks on each side by a spring mechanism that enables separation after the separation process is initiated in flight. This is true even if no airborne target is hit by the round. However, if a target is engaged by this round, the respective disks will also separate because the round is almost certain to break apart on impact. Once on the ground, disks pose no explosive ordnance problems. Also, the fact that no pyrotechnic materials are used will reduce logistical burden and therefore also reduce lifecycle costs.

OBJECTS OF THE INVENTION

It is therefore an object of the present invention to provide a formidable kinetic energy air defense round which at the same time will not be a significant risk to innocent ground targets, and;

It is a further object of the present invention to provide a kinetic energy penetrator for air defense that self destructs beyond its operational range into fragments that are not lethal to personnel on ground, and;

It is a still further object of the present invention to provide a kinetic energy penetrator for air defense that does not use pyrotechnic or energetic materials means to activate any self destruct process, and;

It is yet another object of the present invention to provide a kinetic energy penetrator for air defense that does not result in any explosive ordnance cleanup operations following extensive use of this air defense.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purpose of explanation.

DETAILED DESCRIPTION

Figure 1:
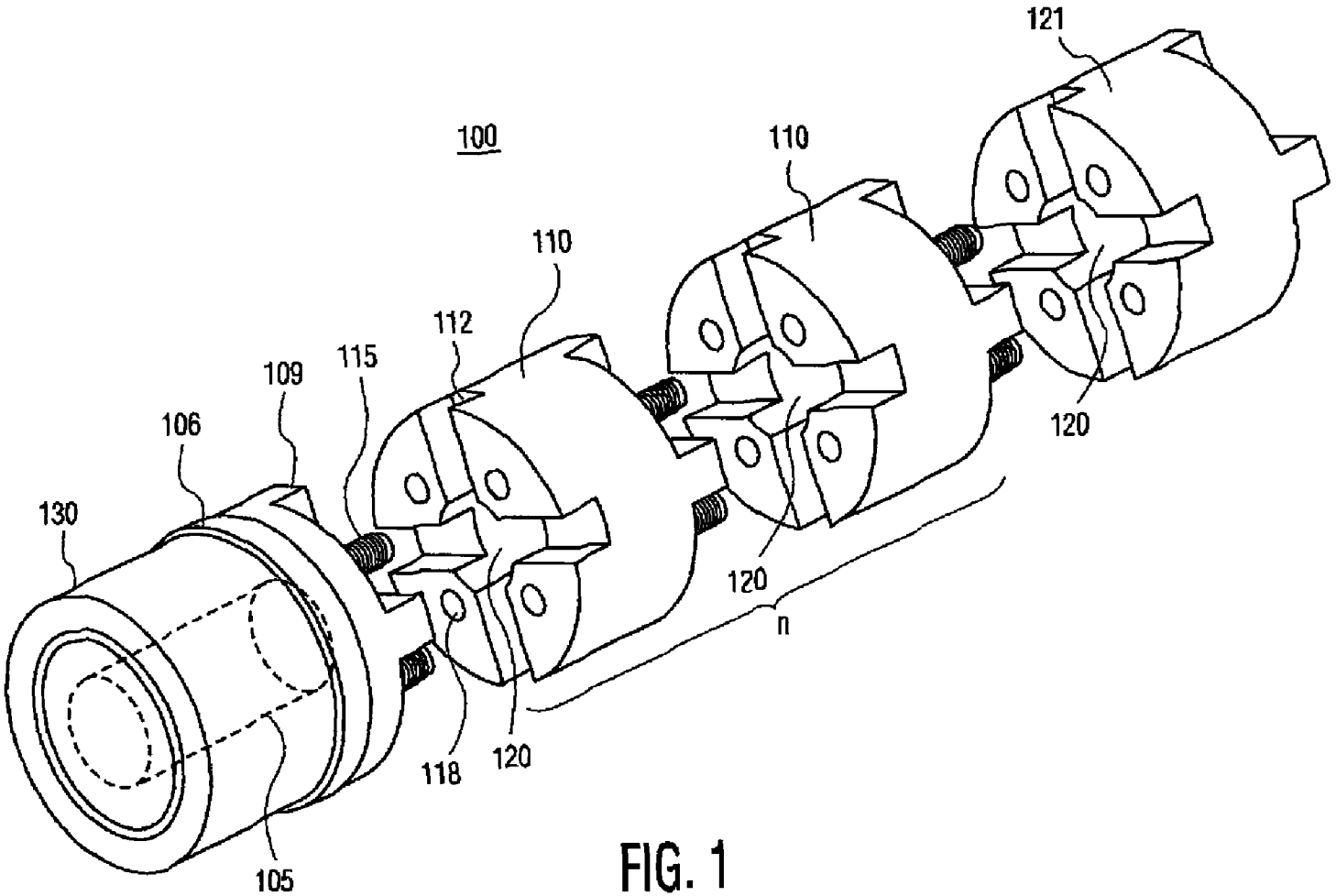
FIG. 1 shows a partial exploded view of a frangible kinetic energy air defense round according to the invention.
Figure 2:
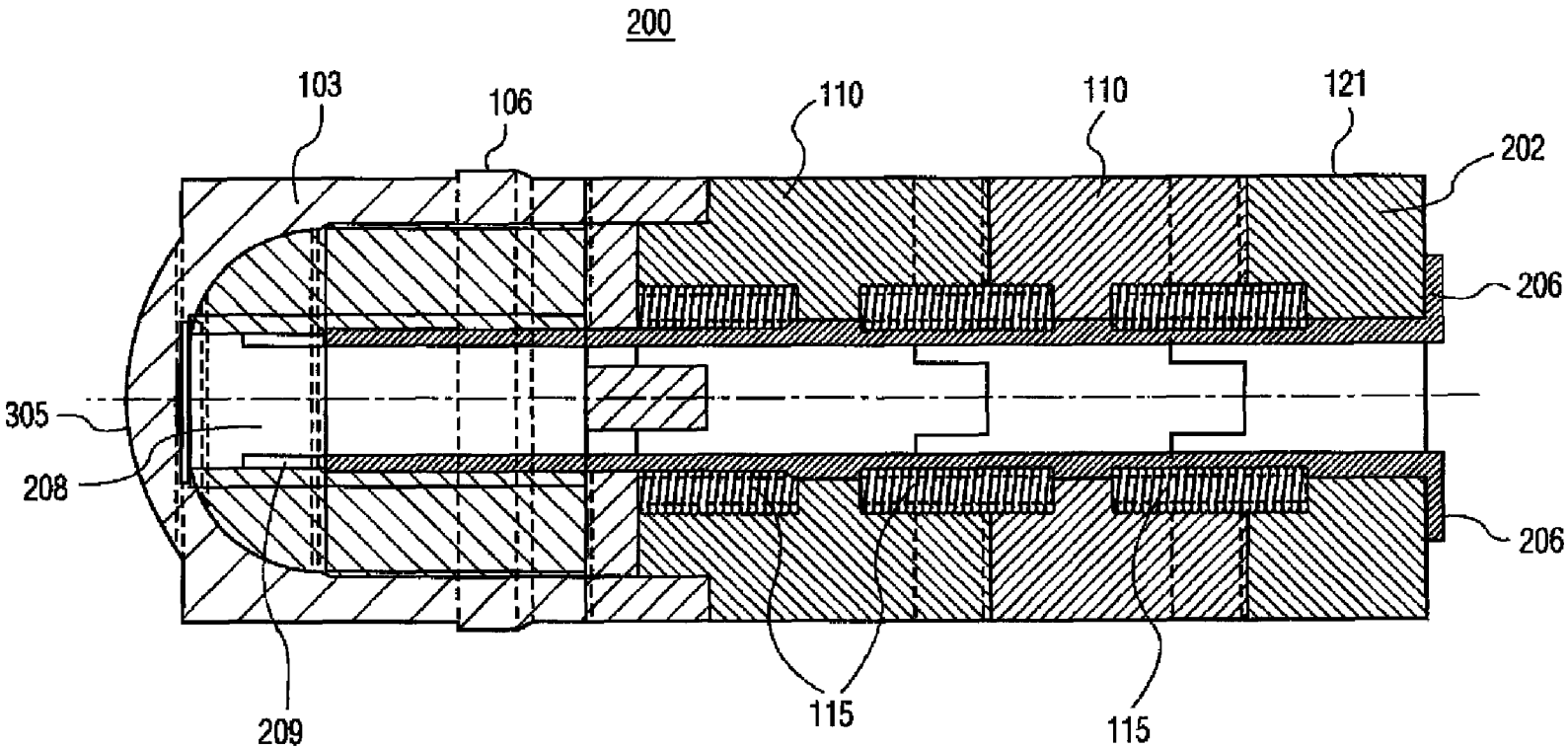
FIG. 2 shows a cross section of an assembled frangible kinetic energy air defense round according to this invention.
Figure 3:
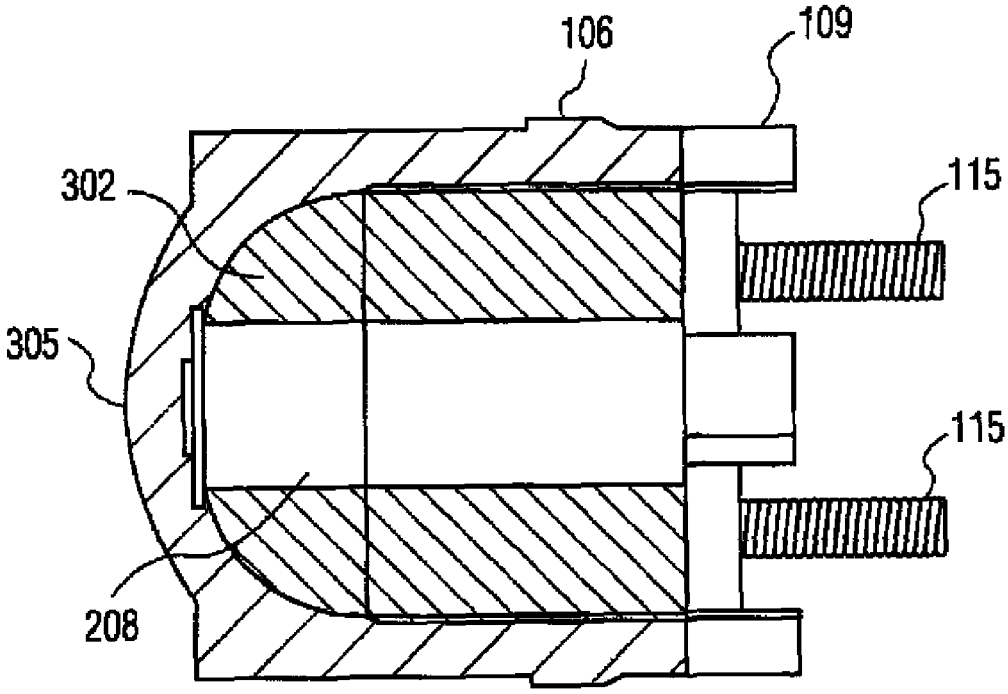
FIG. 3 shows a cross section of front piece 103 of a frangible kinetic energy air defense round according to the invention.

FIG. 1 shows a partial exploded view of a frangible kinetic energy air defense round according to the invention. The round includes a number of "n" separate disks 110, which are mounted between a base (also called end cap) 103, and a nose disk 121 (which could have a disk 110 substituted therefore if easier for manufacture purposes). In practice, the nose disk 121 will lead the round during flight. It will be appreciated that the total weight of the assembled round is actually distributed between the disks 110, the base 103 and the nose disk 121. The weight of this round fully assembled may be considerable so that when fired it can be formidable to destroy a flying target, yet the individual disks 110 or base 103, or nose disk 121 will do far less harm hitting an unintended target on the ground than would the weight of the entire round, if the intended flying target were missed for instance. Although two disks 110 are shown in FIG. 1, this quantity could in theory be changed to a larger or smaller number as may be desired. On the nose side of base 103, and on the nose side of each disk 110, four equidistantly placed springs 115 are included, which springs fit respectively into four recessed holes 118 that are on the base side of each adjacent disk 110 and also on the base side of nose disk 121. The depth of the recessed holes is shallow enough so that all springs 115 are normally in a compressed state when the round is assembled, as shown by the cross sectional view of a fully assembled round (FIG. 2). The nose side of each disk 110 and also the nose side of base 103, also contain four protruding, equidistant, rectangular cross section, robust tabs 109 which are sized to fit into the four slots 112 found on the base side of each adjacent disk 110 and also on the base side of nose disk 121. These interlocking male and female features on opposing sides of the disks serve as shear surfaces to provide adequate torque transfer between the base 103 and its adjacent disk and also thereafter between all adjacent disks, and therefore between the whole stack of disks, and the nose disk 121, during spin up in the rifling of a launching weapon. As illustrated in the cross sectional view FIG. 3, cup shaped base 103 of the projectile is also axisymmetric, with a mass 302 that matches that of each single disk 110, for reasons of providing aerodynamic stability of the assembled round. Similarly, nose disk 121 is also designed to include a mass 202 that is comparable to that of each single disk 110, also for reasons of providing aerodynamic stability of the assembled round. As shown by FIG. 2, there is a central open passageway 208 beginning at the nose side of end cap 305 of base 103 that passes all the way through the round to the nose side of nose disk 121. The passage takes the form of (hidden lines) recessed cylindrical passage 105 in base 103, as well as round passageways 120 (not fully shown in all the Figures) through each disk 110, preferably of equal diameter to 105 and to each other disk 110, and also through the nose disk 121. As illustrated by FIG. 2, wire means 206 are positioned through passageway 208, so that they are attached at 209 in base 103 such as by welding or by other means. The wire means are bent over at the nose side of nose disk 121 so as to hold the round together. The assembled round shown in FIG. 2 may be used as shown or may be further enclosed in an ammunition body with a nose cone for protection or convenience, if desired, but the nose cone must still be able to transfer heat to the wire means and also be easily frangible along with the body. Although two wires are shown here by illustration, in practice this quantity could be increased as deemed necessary to properly hold the round together. As further may be seen in FIG. 2, round 200 is assembled in a normally compressed state; all disks are placed in position with all springs compressed, and then the end of wire means 206 are bent over (or tied, braid in some adequate manner), so as to hold the round together at nose disk 121. There are slip band obturator means 106 on base 103, so that upon firing through a rifled barrel, the assembled round will spin, which aids in flight stability. The wires are made of a shape memory alloy material (SMA) such as Nickel Titanium (NiTi=Nitinol), CuSn, InTi, TiNi, MnCu, CuZnAl, or for instance, gold cadmium alloys. Although the wires may be as shown when the round 200 is assembled, more or less at room temperature, however in flight by reason of air resistance these wires will become heated, soften, and change their shape. Effectively then, the wires will no longer hold in place, or hold the round together when sufficiently heated, and this will allow nose disk 121 and the disks 110 to separate off the wires, further aided by the compressed springs pushing apart all the disks and also the nose disk. It can be appreciated that various variations to wire means 206 geometry and the specific wire material's mechanical response to heating can be used to time the event when the projectile will begin disintegration in flight, and therefore to design for the effective range of the projectile.

While the invention has been described with reference to certain embodiments, numerous changes, alterations and modifications to the described embodiments are possible without departing from the spirit and scope of the invention as defined in the appended claims, and equivalents thereof.

What is claimed is:

1. A frangible kinetic energy ammunition round that comprises:

a plurality of separate equal or engineered mass disks which are mounted between a base and a nose disk, said base having a solid cap thereon and a cylindrical cavity therein beyond the location of said solid cap, and all said disks and said nose disk having a central hole there through of diameter equal to said cylindrical cavity, said base and said nose disk having mass equal to that of a disk, and;

each said disks and said base respectively having several equidistantly placed springs included on the back sides thereof, and several like recessed holes that are on the front side thereof and also on the front side of said nose disk, to receive said springs of a preceding adjacent disk, the depth of such recessed holes resulting in all the springs being in a state of compression in an assembled round, and;

each said disks and said base respectively having several equidistant rectangular tabs included on the back sides thereof, which are sized to fit into several matching equidistant slots found on the front side of each adjacent disk, and also on the front side of the nose disk, which mate to provide adequate torque transfer surfaces between the stack of disks, base, and nose disk during spin up in the launching of the round, and wherein said base has a slip band obturator thereon enables the assembled round to spin upon firing through a rifled barrel, and a plurality of wires of shape memory alloy material, said wires attached on the inside of the base cylindrical cavity and elongating through the central hole of each disk and the central hole of said nose disk, whereupon the wires are bent over at the distal side of said nose disk, and which wires hold together the assembled round in spring and disk compressed state, and;

whereupon heating of the bent wires in flight due to air drag after a predetermined amount of heating causes the wires to change shape and lose hold of the round, causing the disks to be released under spring decompression.

2. The air defense ammunition round of claim 1, wherein the ballistic coefficient of any disk or the end cap is such that its terminal energy is reduced rapidly enough in falling to be less than lethal to persons or property on the ground.

3. The air defense ammunition round of claim 2, wherein each disk and the end cap are all equal in mass.

4. The air defense ammunition round of claim 2, wherein each disk and the end cap are not all equal in mass.

5. The air defense ammunition round of claim 4, wherein the separation of the disks is aided by decompression of the springs when the wire means changes shape to allow for disks to separate from the projectile.

6. A frangible kinetic energy ammunition round as in claim 1, wherein the shape memory material is selected from the group which includes Nitinol, CuSn, InTi, TiNi, MnCu, CuZnAl, and gold cadmium alloy.

* * * * *